US005355646A

United States Patent [19]

Bischel et al.

[11] Patent Number: 5,355,646

[45] Date of Patent: Oct. 18, 1994

[54] CEILING CLIP

[75] Inventors: Wesley T. K. Bischel, Elizabethtown; Brian E. Witmyer, Lititz, both of Pa.

[73] Assignee: Armstrong World Industries, Inc., Lancaster, Pa.

[21] Appl. No.: 33,372

[22] Filed: Mar. 18, 1993

[51] Int. Cl.[5] ..... E04B 9/00

[52] U.S. Cl. ..... 52/489; 24/563

[58] Field of Search ..... 52/481, 486, 489; 24/457, 563, 546

[56] References Cited

U.S. PATENT DOCUMENTS

| | | | |
|---|---|---|---|
| 831,445 | 9/1906 | Kosmatka | 24/563 |
| 1,891,512 | 12/1932 | Venzie | 52/484 X |
| 3,023,468 | 3/1962 | Hord et al. | 24/563 X |
| 3,091,201 | 6/1963 | Williams | 52/489 |
| 4,041,668 | 5/1977 | Jahn et al. | 52/984 X |
| 5,077,951 | 1/1992 | Bakel | 52/484 |
| 5,239,801 | 8/1993 | Adams | 52/484 |

FOREIGN PATENT DOCUMENTS

| | | | |
|---|---|---|---|
| 708716 | 5/1965 | Canada | 52/484 |

*Primary Examiner*—Carl D. Friedman
*Assistant Examiner*—Creighton Smith

[57] ABSTRACT

A clip for retaining a metal ceiling panel in position relative a ceiling runner. The clip will fasten to the horizontal flange of a ceiling runner or the lower end of the wall molding supporting a cut edge of a metal ceiling panel adjacent a wall structure.

2 Claims, 2 Drawing Sheets

Fig. 1
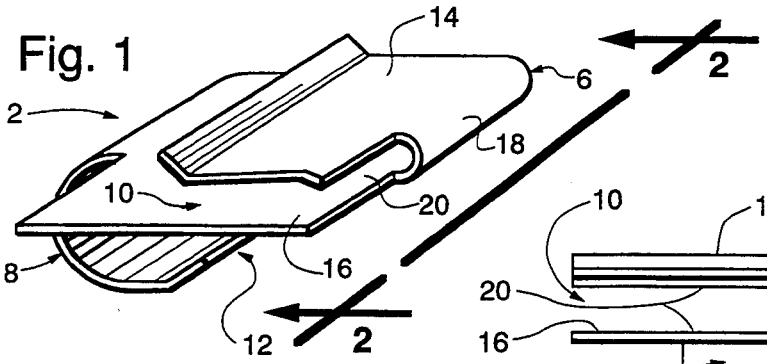
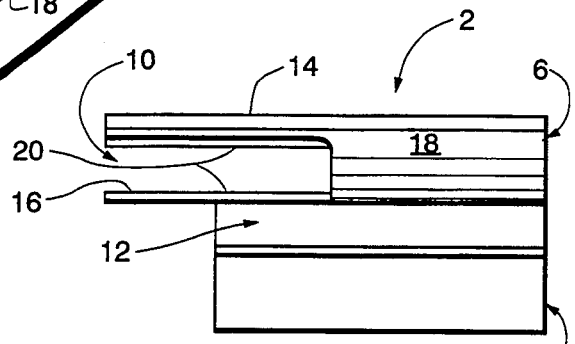
Fig. 2
Fig. 3
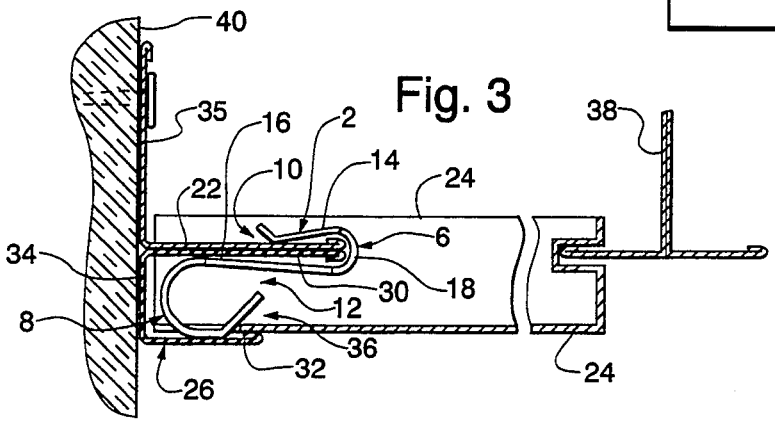
Fig. 4
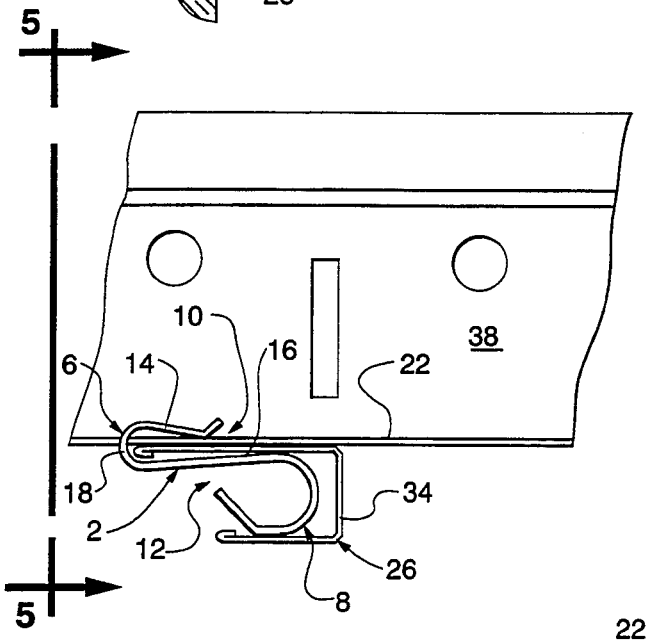
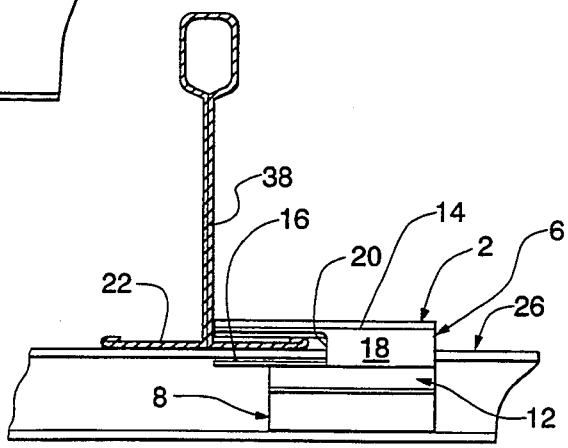
Fig. 5

CEILING CLIP

BACKGROUND OF THE INVENTION

1. Field of the Invention

The invention is a clip for retaining a metal ceiling panel in position adjacent a wall structure.

2. Description of the Prior Act

The only known similar structure is a wall trim clip sold by Alcan Building Products described in their inserts to the Sweet's catalog.

SUMMARY OF THE INVENTION

A clip is used for retaining a metal ceiling panel in position. The clip has a reverse S-shaped cross-section with upper and lower loops. The lower loop is used to retain a ceiling panel in position adjacent to a horizontal strip in a suspended ceiling system The upper loop has an upper and lower side and the distance between the two sides is about ⅛" so that the upper loop can engage the flange of a ceiling runner. The upper loop has a transition section joining the upper and lower sides together and the transition section joins together only a portion of the upper and lower sides to define an open area between the upper and lower sides. In effect, the upper loop is capable of being slipped on the horizontal flange of a wall molding by being inserted straight onto the flange or rotated 90° and slipped on the flange of a runner with the runner between the upper and lower sides of the upper loop and in the open area defined by the transition section.

The clip can be used adjacent a right angle piece of wall molding on the permanent wall of a room to hold the cut edge of the ceiling panel adjacent the wall molding or the clip may be used with the horizontal flange of a runner adjacent a temporary wall which is positioned somewhere between the permanent walls of a room.

BRIEF DESCRIPTION OF THE DRAWING

FIG. 1 is a perspective view of the clip.

FIG. 2 is a side view of the clip of FIG. 1.

FIG. 3 is a showing of the clip being used relative a wall angle at the edge of a room adjacent the permanent wall for the room.

FIG. 4 is a use of the clip midway between the permanent walls of a room adjacent a temporary wall where the clip is positioned on the flange of a runner.

FIG. 5 is a side view of the structure of FIG. 4.

DESCRIPTION OF THE PREFERRED EMBODIMENT

Figure 6:
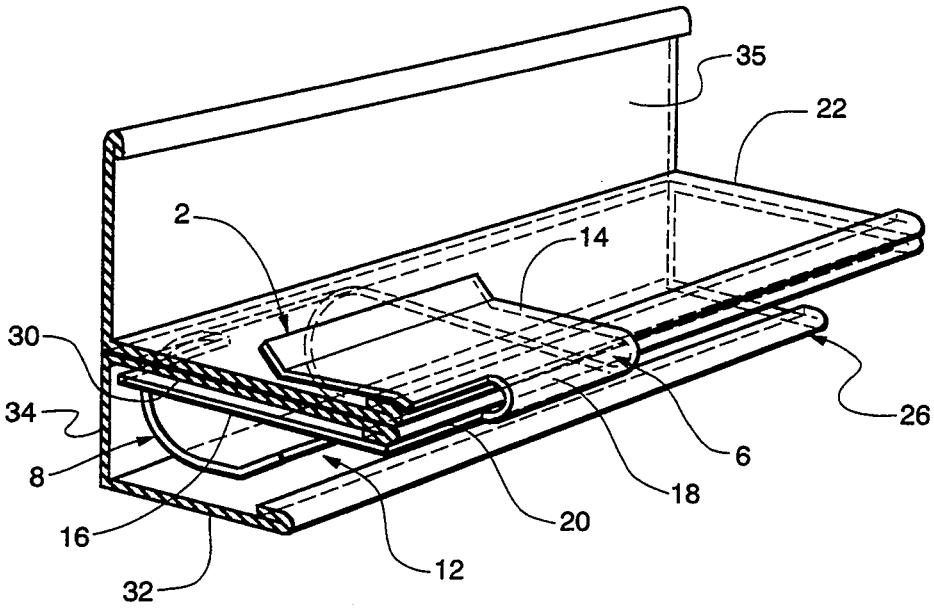
Figure 7:
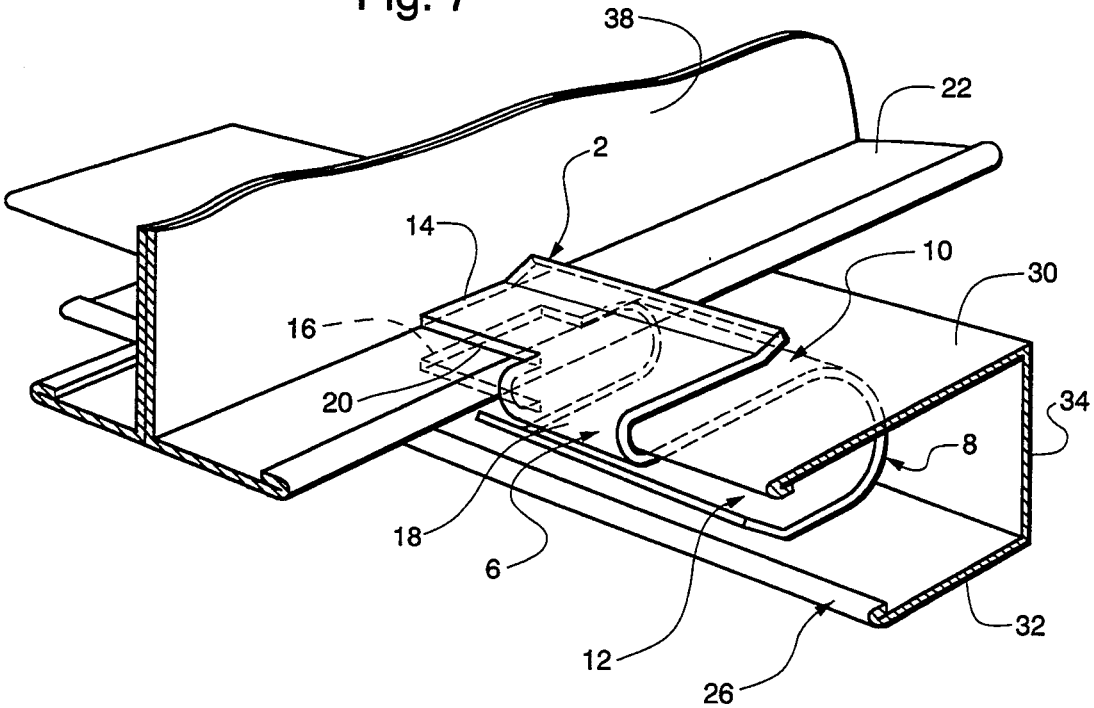

The clip is shown in FIG. 1 and the clip 2 is used for retaining a metal ceiling panel 4 in position relative a permanent or temporary wall structure. The clip has a reverse S-shaped cross-section with an upper loop 6 and a lower loop 8. The open end 10 of the upper loop of the reverse S-shape faces to the left of FIG. 1 and the open end 12 of the lower loop of the reverse S-shape faces to the right of FIG. 1. The upper loop has an upper side 14 and a lower side 16. The distance between the Upper and lower sides being about ⅛" which is very close to the thickness of a conventional ceiling runner flange. The upper loop has a transition section 18 joining the upper and lower sides 14 and 16. The transition section, as seen in FIG. 1, only joins together a portion of the upper and lower sides and, therefore, defines adjacent the transition element an open area 20 which now exists between the upper and lower sides adjacent the transition area. As shown in FIGS. 3 and 5, a flat strip 22 is adapted to receive the clip whereby the clip may be placed on the strip with the strip 22 positioned in the upper loop of the clip and the lower loop of the clip is positioned below the strip as shown in FIG. 3. Alternately, the clip may be placed on the strip as shown in FIG. 5 with the strip positioned in the upper loop of the clip and the open area between the upper and lower sides of the upper loop to position the lower loop of the clip to the side of the strip. In effect, FIG. 5 is a showing of the clip mounted on the horizontal flange of a runner and FIG. 3 is a showing of the clip mounted on a wall molding. FIG. 3 is the use of the clip adjacent a permanent wall structure while FIG. 5 is the use of the strip adjacent a temporary wall structure.

The invention is used as a combination of a clip 2, a metal ceiling panel 24, an inverted T-shaped runner flange 38 or a horizontal flange 22, and a U-shaped support 26. Referring to FIG. 3, a U-shaped support is shown having a top side 30, a bottom side 32 and a transition side 34 joining together the top and bottom sides with an open fourth side 36. The U-shaped support is positioned against a wall angle 35 which has its vertical structure fastened to the permanent wall 40 of a building. The top side of the U-shaped support is positioned below and adjacent the horizontal flange of the wall angle 35 and the clip is placed on the two adjacent horizontal surfaces using the upper loop to engage those surfaces and hold the two surfaces together. The lower loop is now in a position in FIG. 3 to retain the left edge of the metal ceiling panel in position resting upon surface 32 and held thereagainst by the lower loop of the clip. In an alternate environment, the U-shaped support 26, as shown in FIG. 4, is positioned below and adjacent the horizontal flange of the inverted T-shaped runner. The clip is now placed on the horizontal flange of the inverted T-shaped runner and the upper surface of the U-shaped support to hold these two surfaces together. The clip is positioned so that the two adjacent surfaces pass through the open area of the upper loop in addition to being held between the upper side 14 and the lower side 16 of the upper loop. This is a situation where the U-shaped support would have its transition side 34 placed adjacent a temporary wall structure and it is necessary to have the metal ceiling panel cut to fit against the temporary wall and its edge held in position adjacent the temporary wall.

What is claimed is:

1. A clip in combination with an inverted T-shaped runner comprising:

(a) a clip with a reverse S-shaped cross-section with upper and lower loops, the open end of the upper loop of the S-shape faces to the left and the open end of the lower loop of the reverse S-shape faces to the right;

(b) the upper loop having an upper side and lower side, the distance between the upper and lower sides being about ⅛", the upper loop having a transition section joining the upper and lower sides together, said transition section joining together only a portion of the upper and lower sides to define an open area between the upper and lower sides; and (c) said runner having a horizontal flange, said flange adapted to receive the clip whereby the clip may be placed on the flange with the flange positioned in the upper loop of the clip and the lower loop of the clip positioned below the flange, or the clip may be placed on the flange with the flange positioned in the upper loop of the clip and the open area between the upper and lower sides of the upper loop to position the lower loop of the clip to the side of the flange.

2. The combination of a clip, a metal ceiling panel, a U-shaped support and an inverted T-shaped runner comprising:

(a) a clip with a reverse S-shaped cross-section with upper and lower loops, the open end of the upper loop of the S-shape faces to the left and the open end of the lower loop of the reverse S-shape faces to the right;

(b) the upper loop having ar upper side and lower side, the distance between the upper and lower sides being about ⅛", the upper loop having a transition section joining the upper and lower sides together, said transition section joining together only a portion of the upper and lower sides to define an open area between the upper and lower sides;

(c) a metal ceiling panel having four sides;

(d) a U-shaped support having a top side, a bottom side and a transition side joining together the top and bottom sides and an open fourth side;

(e) an inverted T-shaped runner with a horizontal flange at the lower end thereof; and (f) said top side of the U-shaped support being positioned below and adjacent the horizontal flange of the inverted T-shaped runner, said clip placed on the horizontal flange of the inverted T-shaped runner with the horizontal flange of the inverted T-shaped runner and top side of the U-shaped support positioned in the upper loop of the clip and the open area of the upper loop to hold together the clip, runner and U-shaped support with the lower loop of the clip positioned between the top and bottom sides of the U-shaped support, and one side of the metal ceiling panel being positioned on the bottom side of the U-shaped support and held between said bottom side and the lower loop of the clip.

* * * * *